United States Patent [19]

Hogan et al.

[11] 4,386,883

[45] Jun. 7, 1983

[54] MATERIALS LIFTING APPARATUS

[75] Inventors: Arthur S. Hogan; Paul G. McCann, Jr., both of Oklahoma City, Okla.

[73] Assignee: Rig-A-Matic, Inc., Oklahoma City, Okla.

[21] Appl. No.: 192,440

[22] Filed: Sep. 30, 1980

[51] Int. Cl.[3] ..... E21B 19/14

[52] U.S. Cl. ..... 414/22; 198/863; 414/748

[58] Field of Search ..... 414/22, 477, 728, 742, 414/745, 748; 198/863; 105/187, 198; 104/120, 246; 175/85; 211/605

[56] References Cited

U.S. PATENT DOCUMENTS

| | | | |
|---|---|---|---|
| Re. 29,020 | 11/1976 | Moody et al. | 414/22 X |
| 828,409 | 8/1906 | Kazubek | 104/246 |
| 2,631,741 | 3/1953 | Tucker . | |
| 2,643,006 | 6/1953 | King | 414/22 |
| 2,656,052 | 10/1953 | Tucker | 414/22 |
| 2,790,683 | 4/1957 | Clark . | |
| 2,958,430 | 11/1960 | Robishaw . | |
| 3,010,564 | 11/1961 | Drew | 104/120 X |
| 3,513,988 | 5/1970 | Wilson | 414/748 |
| 3,559,821 | 2/1971 | James | 414/22 |
| 3,792,783 | 2/1974 | Brown | 414/748 X |
| 4,054,210 | 10/1977 | Crocker . | |
| 4,067,453 | 1/1978 | Moller | 414/22 |
| 4,235,566 | 11/1980 | Beeman et al. | 414/22 |

FOREIGN PATENT DOCUMENTS 2011870 7/1979 United Kingdom ..... 414/748

OTHER PUBLICATIONS

Mereco Machine, Odessa, Texas.

*Primary Examiner*—Leslie J. Paperner

*Attorney, Agent, or Firm*—Dunlap & Codding

[57] ABSTRACT

A materials lifting apparatus for transporting materials, such as pipe between a derrick floor and a pipe rack, which comprises a support frame having a carriage receiving passageway therein, a carriage positionable within the carriage receiving passageway, and a forward linkage assembly pivotally connecting a first end portion of the carriage to the support frame, the forward linkage assembly being movable between a lowered position and a raised position, in the lowered position of the forward linkage assembly the carriage being disposed in a substantially horizontal position within the carriage receiving passageway of the support frame, in the raised position of the forward linkage assembly the first end portion of the carriage being disposed in a raised, longitudinally shifted position. The materials lifting apparatus is also provided with a track assembly operably connected to an opposed second end portion of the carriage such that as the forward linkage assembly is moved between the lowered position and the raised position the opposed second end portion of the carriage slidably moves in the carriage receiving passageway of the support frame.

30 Claims, 11 Drawing Figures

MATERIALS LIFTING APPARATUS

BACKGROUND OF THE INVENTION

1. Field of the Invention

This invention relates generally to a materials lifting apparatus, and more particularly, but not by way of limitation, to an improved materials lifting apparatus for transporting pipe between a pipe rack and a derrick floor.

2. Description of the Prior Art

In the drilling of a well tubular goods, such as drill pipe, production tubing, casing, and the like, must be transported between a pipe rack or ground level and a derrick floor. The transporting of such tubular goods during the drilling operation is one of the most dangerous aspects of a well boring operation in the drilling of a well. For example, the various sections of pipe are generally laid down in horizontal rows on a pipe rack in a side-by-side relationship at a location in the vicinity of the drilling derrick, and the pipe must be transferred to and from the derrick floor, as necessary. Similarly, when pulling tubular goods from the bore hole of the well the joints of the tubular goods must be broken down from the string of pipe and returned to the pipe rack. Because of the weight of each of the various sections of the tubular goods employed in the drilling operation, and the necessity of moving such goods between the ground and the derrick floor, devices have heretofore been proposed to assist in the movement of the tubular goods in an effort to reduce the dangers encountered by those working on the well, especially where the danger is a result of the movement of the tubular goods between the ground level and the derrick floor.

Typical of the prior art devices are the pipe handling apparatus disclosed in U.S. Pat. Nos. 3,825,129 and 4,099,630. The pipe handling apparatus of the before mentioned patents employ a cable assembly which overhangs the derrick floor and the pipe rack, the cable assembly being adapted to move the pipe therebetween.

Various other pipe handling apparatus for transfer of pipe from a drilling rig floor to a pipe rack have heretofore been known. Many of the prior art devices have required men to physically move the pipe from the pipe rack to the lifting apparatus and vice versa, or have employed a plurality of cables, winches and the like which are unstable and often cause problems when such devices are employed to move pipe between the drilling rig floor and the pipe rack. Thus, the need has long been recognized for an improved lifting apparatus which can more efficiently handle tubular goods employed in the drilling of a well, as well as moving the tubular goods between a pipe rack and the derrick floor.

SUMMARY OF THE INVENTION

According to the present invention an improved materials lifting apparatus is provided for transporting goods from a lower position to a raised position, such as the transporting of tubular goods used in a drilling operation between a pipe rack and a derrick floor. Broadly, the apparatus of the present invention comprises a support frame having a carriage receiving passageway formed therein, a carriage positionable within the carriage receiving passageway, and a forward linkage assembly pivotally connecting the carriage to the support frame. The forward linkage assembly is movable between a lowered position and a raised position. In the lowered position of the forward linkage assembly the carriage is substantially horizontally positioned within the carriage receiving passageway of the support frame, and in the raised position of the forward linkage assembly one end portion of the carriage is disposed in a raised, longitudinally shifted position with respect to the support frame. More specifically, the materials lifting apparatus further comprises a track disposed within the carriage receiving passageway of the support frame and positioned between the carriage and the support frame, and a track engaging assembly connected to the carriage, the track engaging assembly slidably connecting the other end portion of the carriage to the track so that as the forward linkage assembly is moved between the lowered position and the raised position, the other end of the carriage slidably moves along the track.

An object of the present invention is to provide an improved apparatus for transporting materials from a lowered position to a raised position.

Another object of the present invention is to provide an improved apparatus for moving tubular goods between a pipe rack and a derrick floor.

Other objects, advantages and features of the present invention will become apparent to those skilled in the art of materials lifting apparatus from the reading of the following detailed description when read in conjunction with the accompanying drawings and the appended claims.

BRIEF DESCRIPTION OF THE DRAWINGS

FIG. 3 is a side elevational view of the materials handling apparatus of the present invention illustrating the carriage of the apparatus in a lowered position, the carriage being disposed in a carriage receiving passageway of the support frame of the apparatus.

FIG. 6 is a perspective view of the carriage of the materials lifting apparatus of the present invention, depicting a plurality of slots therein.

DETAILED DESCRIPTION OF THE PREFERRED EMBODIMENTS

In order to illustrate the materials lifting apparatus of the present invention generally, as well as in detail, certain features of the apparatus have been presented schematically in some of the drawings which provide views of the overall construction of the apparatus. These views are supplemented by other drawings which provide detailed views of preferred modes of construction of the features and reference will be made below to the drawings wherein the detailed views are presented. It will be understood that the detailed views represent the preferred construction.

Figure 1:
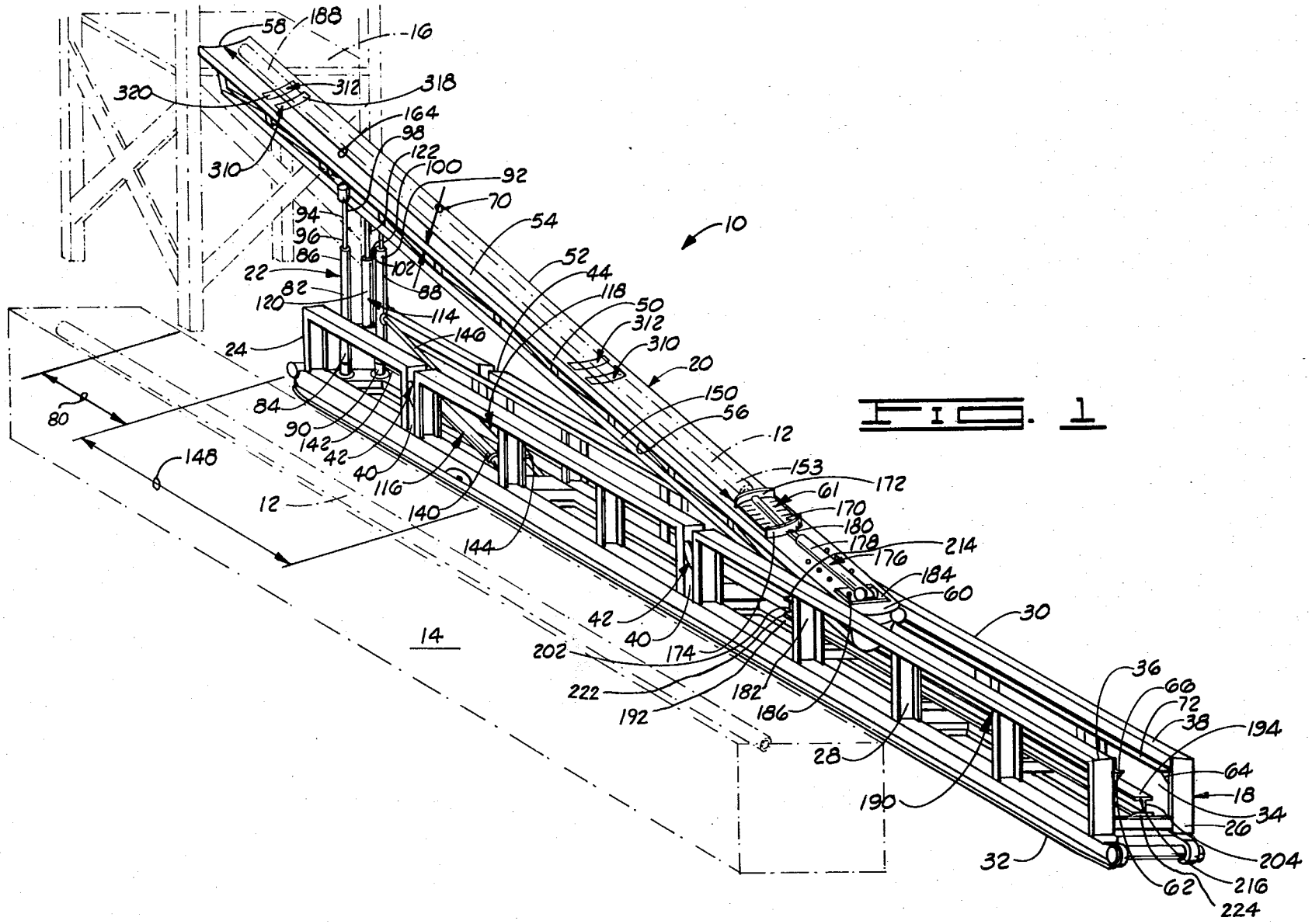
FIG. 1 is a perspective view of the materials lifting apparatus of the present invention illustrating the apparatus in a raised position for transporting a pipe, shown in phantom, to a derrick floor, also shown in phantom.

Referring now to the drawings, and particularly to FIG. 1, shown therein and represented by the numeral 10 is a materials lifting apparatus constructed in accordance with the present invention. The materials lifting apparatus 10, illustrated as an apparatus for moving sections of pipe 12 between a pipe rack 14 and a derrick floor 16, comprises a support frame 18, a carriage 20, and forward linkage assembly 22. The support frame 18 is provided with a first end 24, an opposed second end 26, a first side 28, a parallel, spatially disposed second side 30, and a lower side 32. The first side 28 and the second side 30 of the support frame 18 are connected via the lower side 32 of the support frame 18 such that the first side 28, the second side 30, and the lower side 32 of the support frame 18 define a carriage receiving passageway 34 therein.

The first side 28 of the support frame 18 is provided with an angularly disposed upper end 36; and the second side 30 of the support frame 18 is provided with an angularly disposed upper end 38. The angularly disposed upper ends 36, 38 of the first and second sides 28, 30, respectively, of the support frame 18 extend in an outward, downward direction away from the carriage receiving passageway 34 formed in the support frame 18 substantially as shown in the drawings. The angular disposition of the upper ends 36, 38 of the first and second sides 28, 30 of the support frame 18 assist in the removal of the pipe 12 from the carriage 20 as will be more fully described hereinafter.

The first side 28 of the support frame 18 is further provided with a plurality of vertically disposed slots 40 which extend through the upper end 36 thereof. A pipe loading assembly 42 is positionable within each of the slots 40 and the pipe loading assemblies 42 are connected to the support frame 18 such that the pipe loading assemblies 42 can engage a section of pipe 12 on the pipe rack 14 and move the pipe 12 to the carriage 20 of the materials lifting apparatus 10.

Figure 4:
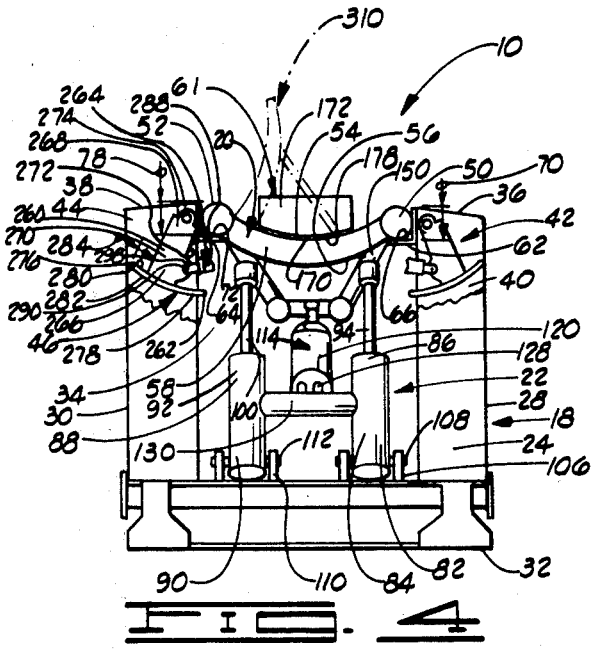
FIG. 4 is a partially broken, front end view of the materials lifting apparatus of the present invention when the carriage is in the lowered position illustrating a plurality of pipe loading assemblies in a lowered inoperative position, one of the pipe loading assemblies and a pipe ejecting assembly of the apparatus being illustrated in phantom in the raised, operative position.

Similarly, the second side 30 of the support frame 18 is provided with a plurality of vertically disposed slots 44 extending through the upper end 38 thereof. A pipe loading assembly 46 (One of the pipe loading assemblies 46 is illustrated in FIG. 4.) is positioned within each of the slots 44 and the pipe loading assemblies 46 are connected to the support frame 18. Thus, if the pipe rack 14 is positioned adjacent the second side 30 of the support frame 18 the pipe loading assemblies 46 can be employed to move the pipe 12 from the pipe rack 14 to the carriage 20 of the materials lifting apparatus 10.

Referring now to FIG. 6, the carriage 20, an elongated member, is provided with a first side 50, an opposed second side 52, an upper side 54, a lower side 56, a first end 58, and an opposed second end 60. The upper side 54 of the carriage 20, a concave cylindrically shaped materials supporting surface, is provided with an adjustable stop assembly 61 (see FIG. 1.) for supporting materials, such as the pipe 12, thereon as the carriage 20 is moved between the raised and lowered positions as depicted in FIGS. 1 and 3.

As set forth hereinbefore, and as illustrated in FIGS. 3 and 4, the carriage 20 is positionable within the carriage receiving passageway 34 of the support frame. When the carriage 20 is positioned in the carriage receiving passageway 34 of the support frame 18 (i.e. the carriage 20 is in the lowered position) the first side 50 of the carriage 20 is positioned substantially adjacent the first side 28 of the support frame 18 such that the adjacent portion of the upper side 54 of the carriage 20 is substantially aligned with the adjacent portion of the upper end 36 of the first side 28 of the support frame 18; and the second side 52 of the carriage 20 is positioned substantially adjacent the second side 30 of the support frame 18 such that the adjacent portion of the upper side 54 of the carriage 20 is substantially aligned with the adjacent portion of the upper end 38 of the second side 30 of the support frame 18.

Figure 5:
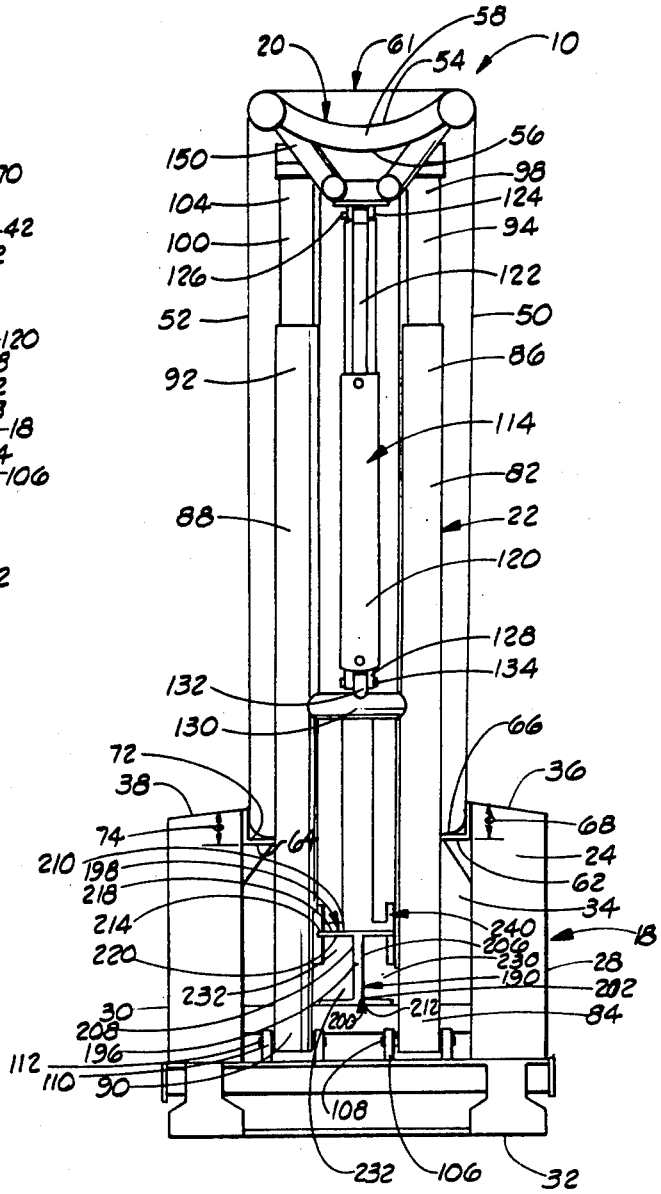
FIG. 5 is a front end view of the materials lifting apparatus of the present invention when the carriage is in the raised position as illustrated in FIG. 1.

As more clearly shown in FIGS. 1, 4 and 5, the carriage 20 of the materials lifting apparatus 10 is supported in the carriage receiving passageway 34 of the support frame 18 by a pair of support members 62 and 64. Support member 62, an elongated L-shaped member, is connected to the first side 28 of the support frame 18 such that the support member 62 extends into the carriage receiving passageway 34 of the support frame 18. The carriage support member 62 thus forms a substantially horizontally disposed carriage support surface 66 which is positioned a distance 68 from the upper end 36 of the first side 28 of the support frame 18. The distance 68 between the support surface 66 of the support member 62 and the upper end 36 of the first side 28 of the support frame 18 substantially corresponds to a depth 70 of the first side 50 of the carriage 20.

The support member 64, an elongated L-shaped member, is connected to the second side 30 of the support frame 18 such that the support member 64 extends a distance into the carriage receiving passageway 34 of the support frame 18. The carriage support member 64 thus forms a substantially horizontally disposed carriage support surface 72 which is positioned a distance 74 from the upper end 38 of the second side 30 of the support frame 18. The distance 74 between the carriage support surface 72 of the support member 64 and the upper end 38 of the second side 30 of the support frame 18 substantially corresponds to a depth 78 (See FIG. 4) of the second side 52 of the carriage 20. The support members 62 and 64 as described above cooperate to support the carriage 20 of the materials lifting apparatus 10 in the carriage receiving passageway 34 when the carriage 20 is in the lowered position. Further, the support members 62, 64 slidingly support the opposed second end 60 of the carriage 20, and thus support the carriage 20 as the carriage 20 is moved between the raised position and the lowered position via the forward linkage assembly 22.

Figure 2:
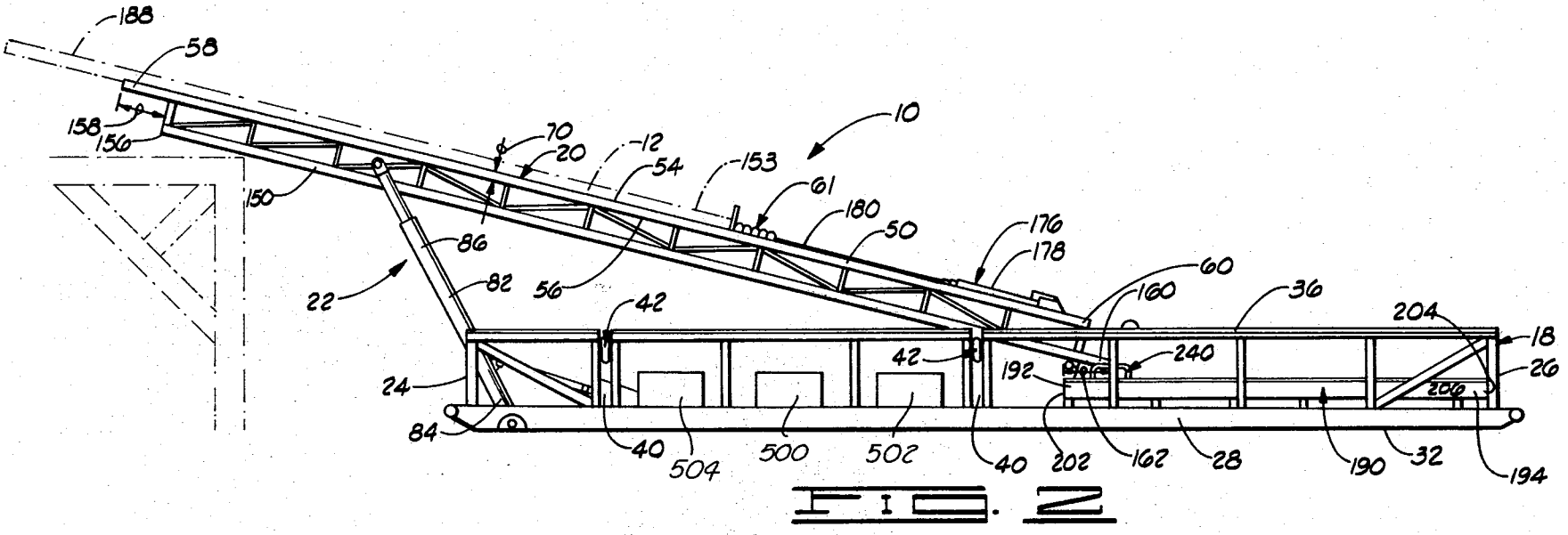
FIG. 2 is a side elevational view of the materials lifting apparatus of the present invention illustrating the apparatus in a second raised position wherein one end portion of the carriage of the apparatus is disposed above the derrick floor, the derrick floor and a section of pipe supported by the carriage of the materials lifting apparatus being illustrated in phantom.
Figure 1:
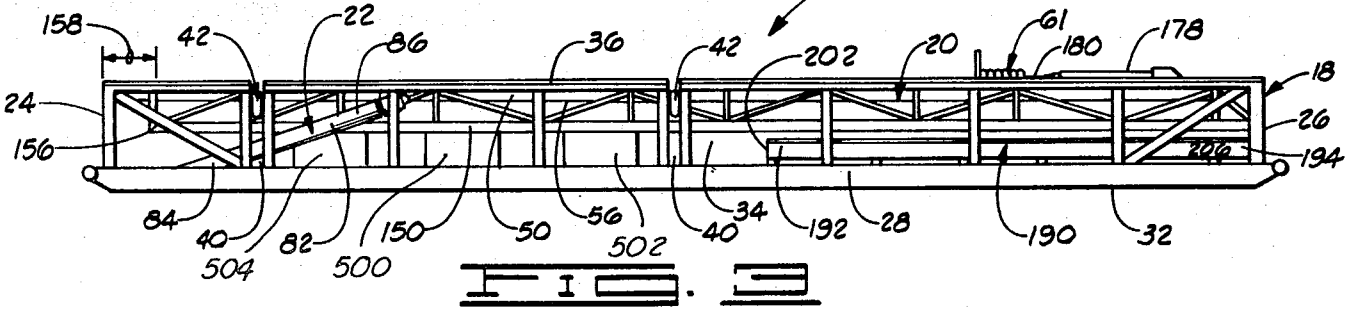

Referring specifically to FIG. 1, the forward linkage assembly 22 of the materials lifting apparatus 10 is disposed between and pivotally connects the first end 58 of the carriage 20 to the lower side 32 of the support frame 18. Thus, as the forward linkage assembly 22 is moved between a lowered position (as shown in FIG. 3) and a raised first position (as shown in FIG. 1) the first end 58 of the carriage 20 is moved from the substantially horizontal position within the carriage receiving passageway 34 of the support frame 18 to the raised first position wherein the first end 58 of the carriage 20 is longitudinally shifted a distance 80 from the first end 24 of the support frame 18. Upon further activation of the forward linkage assembly 22 the first end 58 of the carriage 20 can be moved a second longitudinally shifted position as illustrated in FIG. 2. It should be noted that as the first end 58 of the carriage 20 is moved between one of the first and second raised, longitudinally shifted positions, and the lowered position as described above, the opposed second end 60 of the carriage 20 slidably engages the carriage support surfaces 66, 72 of the support members 62, 64, respectively, of the support frame 18.

The forward linkage assembly 22 comprises a first tubular linkage member 82 having a first end portion 84 and an opposed second end portion 86, a second tubular linkage member 88 having a first end portion 90 and an opposed second end portion 92, a first linkage member 94 having a first end portion 96 and an opposed second end portion 98, and a second linkage member 100 having a first end portion 102 and an opposed second end portion 104 (See FIG. 5.). The first end portion 84 of the first tubular linkage member 82 is pivotally connected to the lower side 32 of the support frame 18 via a clevis 106 and pin 108 (For clarity of illustration, the pivotal connections of the forward linkage assembly 22 to the support frame 18 have been only schematically indicated in FIG. 1. The clevis 106 and pin 108 are shown in FIG. 4.); and the first end portion 90 of the second tubular linkage member 88 is pivotally connected to the lower side 32 of the support frame 18 via clevis 110 and pin 112 (See FIG. 4.) such that the first tubular linkage member 82 is disposed in a substantially parallel, spatial relationship with the second tubular linkage member 88 of the forward linkage assembly 22.

The opposed second end portion 86 of the first tubular linkage member 82 telescopically receives the first end portion 96 of the first linkage member 94 such that the opposed second end portion 98 of the first linkage member 94 extends a distance from the opposed second end portion 86 of the first tubular linkage member 82. Similarly, the opposed second end portion 92 of the second tubular linkage member 88 telescopically receives the first end portion 102 of the second linkage member 100 so that the opposed second end portion 104 of the second linkage member 100 extends a distance from the opposed second end portion 92 of the second tubular linkage member 88.

The opposed second end portions 98, 104 of the first and second linkage members 94, 100, respectively, are pivotally connected to the carriage 20 of the materials lifting apparatus 10 near the first end 58 thereof substantially as shown in FIG. 2. The pivotal connection of the opposed second end portions 98, 104 of the first and second linkage members 94, 100, respectively, to the carriage 20 can be achieved by any suitable means well known in the art, such as by a clevis and pin as indicated in FIG. 2.

The forward linkage assembly 22 further comprises a plurality of rams, such as rams 114, 116 and 118, which cooperate to selectively move the first tubular linkage member 82, the first linkage member 94, the second tubular linkage member 88 and the second linkage member 100 so that the carriage 20 of the materials lifting apparatus 10 can be moved between the lowered position (as shown in FIG. 3 wherein the carriage 20 is horizontally disposed in the carriage receiving passageway 34 of the support frame 18) and the first raised position (as shown in FIG. 1) wherein the first end 58 of the carriage 20 is moved to the raised, longitudinally shifted position). Upon further activation of the rams 114, 116 and 118 the first tubular linkage member 82, the first linkage member 94, the second tubular linkage member 88, and the second linkage member 100, and thus carriage 20 of the materials lifting apparatus 10 can be moved between the first raised longitudinally shifted position (as shown in FIG. 1) and the second raised longitudinally shifted position (as shown in FIG. 2).

The ram 14 is provided with a base portion 120 and a reciprocating rod 122. The ram 114 is positioned between the first and second tubular linkage members 82, 88 of the forward linkage assembly 22. The reciprocating rod 122 of the ram 114 is pivotally connected to the carriage 20 via a clevis 124 and pin 126 (See FIG. 5), and the base portion 120 of the ram 114, which is provided with a clevis 128, is pivotally connected to a support member 130 positioned between and connected to the first and second tubular linkage members 82, 88, via the clevis 128, a lug 132 secured to the support member 130, and a pin 134.

Ram 116 is provided with a base portion 140 and a reciprocating rod 142; and ram 118 is provided with a base portion 144 and a reciprocating rod 146. The base portion 140 of the ram 116 is pivotally connected to the lower side 32 of the support frame 18 a distance 148 from the first end 24 of the support frame 18; and the base portion 144 of the ram 118 is pivotally connected to the lower side 32 of the support frame 18 a distance (not shown) from the first end 24 of the support frame 18 such that the base portions 140, 144 of the rams 116, 118 are pivotally connected to the support frame 18 in a parallel, spatial relationship.

The reciprocating rod 142 of the ram 116 is pivotally connected to the first tubular linkage member 82 of the forward linkage assembly 22 at a position substantially intermediate the first end portion 84 and the opposed second end portion 86 of the first tubular linkage member 82 and the reciprocating rod 146 of the ram 118 is pivotally connected to the second tubular linkage member 88 of the forward linkage assembly 22 at a position intermediate the first end portion 90 and the second end portion 92 of the second tubular linkage member 88 substantially as shown in FIG. 1. The pivotal connection of the reciprocating rods 142, 146 to the first and second tubular linkage members 82, 88 can be achieved by any suitable means well known in the art, such as clevises, lugs, and pins (not shown); and the base portions 140, 144 of the rams 116, 118 can be pivotally connected to the lower side 32 of the support frame 18 by any suitable means well known in the art, such as clevises, lugs, and pins (also not shown).

The rams 114, 116, and 118 employed in the forward linkage assembly 22 of the materials lifting apparatus 10 of the present invention can be any suitable ram well known in the art, such as a double-acting hydraulic ram. Since such rams are well known in the art no further comment is believed necessary. However, it should be noted that the rams 116 and 118 can be connected hydraulically either in parallel or series provided the movement of the reciprocating rods 142, 146 of the rams 116, 118 is synchronized. Further, the cooperation between the rams 114, 116, and 118, the first and second tubular linkage members 82, 88, and the first and second linkage members 94, 100, as well as the relationship therebetween, enables one, upon activation of the rams 116 and 118 to move the carriage 20 of the materials lifting apparatus 10 between the lowered position as illustrated in FIG. 1 and one of the raised first longitudinally shifted position and the raised second longitudinally shifted position as illustrated in FIGS. 2 and 3. In addition, actuation of the ram 114 enables one to adjust the heighth of the first end 58 of the carriage 20 when the carriage is in one of the raised first position and the raised second position.

Referring more specifically to FIGS. 1 and 6, the carriage 20 of the materials lifting apparatus 10 further comprises a support frame 150, and the adjustable stop assembly 61. The support frame 150 is secured to the lower side 56 of the carriage 20 such that a first end 156 of the support frame 150 terminates a distance 158 from the first end 58 of the carriage 20, and a second end 160 of the support frame 150 extends a distance 162 outwardly from the opposed second end 60 of the carriage 20 as shown in FIG. 6.

As shown in FIG. 1, the adjustable stop assembly 61 is positioned on the upper side 54 of the carrier 20 such that the adjustable stop assembly 61 is disposed a selected distance 164 from the first end 58 of the carriage 20, the distance 164 being substantially equal to the length of the pipe 12. Thus, the adjustable stop assembly 61 engages one end 153 of the pipe 12 supported on the upper side 54 of the carriage 20 and stabilizes the pipe 12 on the carriage 20 as the carriage 20 is moved between the lowered position and one of the raised positions as heretofore described.

The adjustable stop assembly 61 comprises a base plate 170, a pair of substantially vertically disposed upright members 172, 174, and a ram 176. The base plate 170 of the adjustable stop assembly 61 is positioned on the upper side 54 of the carriage 20 for sliding engagement along the upper side 54 of the carriage 20 as the base plate 170 is moved in response to actuation of the ram 176. Preferably the lower surface of the base plate 170, has a configuration substantially corresponding to the concave cylindrical shaped materials supporting surface of the upper side 54 of the carriage 20.

The upright member 172 of the adjustable stop assembly 61 is connected to one end portion of the base plate 170 such that the upright member 172 is disposed substantially normal to the base plate 170; and the upright member 174 of the adjustable stop assembly 61 is secured to the other end portion of the base plate 170 such that the upright member 174 is disposed substantially normal to the base plate 170 as shown in FIG. 1.

The ram 176 of the adjustable stop assembly 61 is provided with a base portion 178 and a reciprocating rod 180. The reciprocating rod 180 is connected to the upright member 174 of the adjustable stop assembly 61 and the base portion 178 of the ram 176 is connected to the carriage 20 of the materials lifting apparatus 10. As is apparent the length of travel of the base plate 170, and thus the upright members 172, 174 is limited by the length of the stroke of the reciprocating rod 180 of the ram 176. Thus, it is desirable that the adjustable stop assembly 61 be capable of being selectively positioned on the upper side 54 of the carriage 20 so that the materials lifting apparatus 10 can be effectively used on varying lengths of pipe. In order to obtain the before-mentioned flexibility, the carriage is provided with a plurality of apertures, such as apertures 182. The base portion 178 of the ram 176 is connected to a plate 184 having a plurality of apertures (not shown). The apertures (not shown) in the plate 184 can be aligned with selected apertures 182 in the carriage 20 so that upon positioning a plurality of bolts 186 in the aligned apertures of the plate 184 and the carriage 20 the plate 184 can be secured to the carriage 20 substantially as shown in FIG. 1.

Once the adjustable stop assembly 61 has been secured to the carriage 20 in the selected position so that the pipe 12 positioned on the carriage 20 abuts the upright member 172 of the adjustable stop assembly 61, and the pipe 12 extends from the upright member 172 of the adjustable stop assembly 61 to the first end 58 of the carriage 20 (as illustrated in FIG. 1), the pipe 12 can be moved to a position (See FIG. 2) wherein an opposed end 188 of the pipe 12 is positioned over the derrick floor 16 when the carriage 20 of the materials lifting apparatus 10 is in the raised, longitudinally shifted position. The movement of the pipe 12 along the carriage 20 is accomplished by activation of the ram 176 of the adjustable stop assembly 61 and the resulting movement of the base plate 170 and the upright members 172, 174 of the adjustable stop assembly 61, the upright member 172 engaging the end 153 of the pipe 12 so that the pipe 12 is slidably moved along the upper side 54 of the carriage 20 in the direction of the first end 58 of the carriage 20. When one desires to remove the pipe 12 from the derrick floor 16, the ram 176 is activated to the position illustrated in FIG. 2, and the pipe 12 is positioned on the carriage 20 as that end 153 of the pipe 12 engages the upright member 172 of the adjustable stop assembly 61. Thereafter, the reciprocating rod 180 of the ram 176 is retracted and the pipe 12 is allowed to move along the upper side 54 of the carriage 20 in the direction of the opposed second end 60 of the carriage 20. Once the pipe 12 has been positioned on the upper side 54 of the carriage 20, the carriage 20 can be lowered to the substantially horizontally disposed position within the carriage receiving passageway 34 of the support frame 18.

The ram 176 employed as a component of the adjustable stop assembly 61 of the materials handling apparatus 10 of the present invention can be any suitable double-acting ram, such as a double acting hydraulic ram. Such rams are well known in the art. Thus, no further description of the ram is believed necessary. Further, the base portion 178 of the ram 176 can be connected to the plate 184 by any suitable means, such as by a clevis and pin (not shown).

With continued reference of FIG. 1, the materials lifting apparatus 10 further comprises a track 190 having a first end 192 and an opposed second end 194. The track 190 is secured to the lower side 32 of the support frame 18 such that the track 190 is positioned a distance below the carriage 20 when the carriage 20 is in the lowered, horizontally disposed position in the carriage receiving passageway 34 of the support frame 18. The track 190 is positioned within the carriage receiving passageway 34 of the support frame 18 such that the opposed second end 194 of the track 190 is substantially adjacent the opposed second end 26 of the support frame 18. The track 190 extends from the opposed second end 26 of the support frame 18 in the direction of the first end 24 of the support frame 18 such that the first end 192 of the track 190 terminates at a position within the carriage receiving passageway 34 of the support frame 18 intermediate the first and opposed second ends 24, 26 of the support frame 18.

The track 190, illustrated as an I-beam, comprises a substantially vertically disposed elongated member 196, an upper flange member 198, and a substantially parallel, spatially disposed lower flange member 200. The elongated member 196 of the track 190 is provided with a first end 202, an opposed second end 204, a first side 206, an opposed second side 208, an upper side 210, and an opposed lower side 212. The upper flange member 198 is provided with a first end 214, an opposed second end 216, an upper side 218, and an opposed lower side 220. Similarly, the lower flange member 200 is provided with a first end 222, an opposed second end 224, an upper side 226, and an opposed lower side 228. The upper side 210 of the elongated member 196 is connected to the upper flange member 198 via the opposed lower side 220 of the upper flange 210; and the opposed lower side 208 of the elongated member 196 is connected to the upper side 226 of the lower flange member 200 substantially as shown in the drawing and to provide the track with an I-shaped configuration. Thus, first side 206 of the elongated member 196, a portion of the lower side 220 of the upper flange member 198, and a portion of the upper side 226 of the lower flange member 200 cooperate to form a first channel 230 therebetween; and the opposed second side of the elongated member 196, a portion of the lower side 220 of the upper flange 198, and a portion of the upper side 226 of the lower flange 200 cooperate to form a second channel 232 therebetween. The track 190 formed of the elongated member 196, the upper flange member 198, and the lower flange member 220 can be fabricated as a unitary member, or as a multi-component member.

Figure 8:
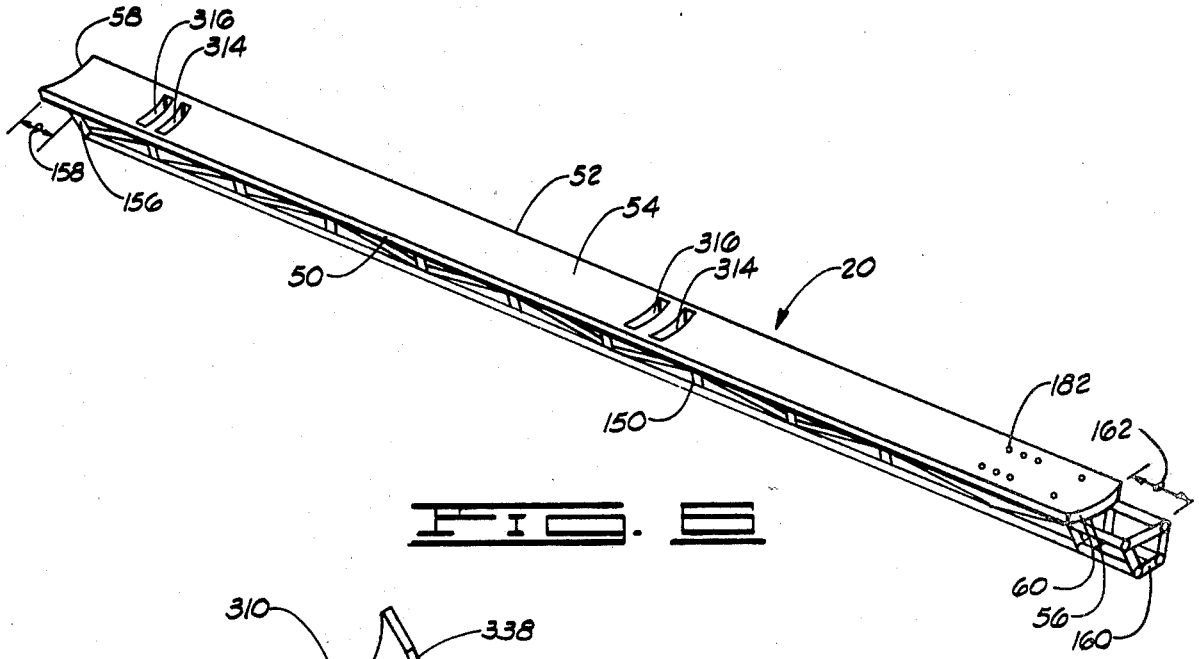
FIG. 8 is an enlarged, partially broken end view illustrating one end portion of the carriage connected to a track of the materials lifting apparatus via a track engaging assembly.

The track 190 as described above is adapted to engage a track engaging assembly 240 (see FIGS. 8 and 9) pivotally connected to the second end 160 of the support frame 150. The track engaging assembly 240 comprises a vertically disposed first support plate 242 having a plurality of wheels 244 journally connected thereto, and a parallel, spatially disposed second support plate 246 having a plurality of wheels 248 journally connected thereto. The first and second support plates 242, 246 thus form a space 250 therebetween, into which at least a portion of the track 190 can be positioned.

Figure 9:
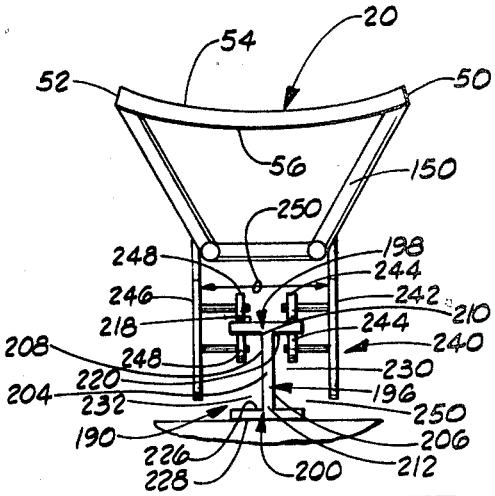
FIG. 9 is an enlarged, partially broken side view illustrating one end portion of the carriage connected to the track via the track engaging assembly of the materials lifting apparatus of the present invention.

As previously stated, the track engaging assembly 240 is pivotally connected to the second end 160 of the support frame 150. Such can be accomplished by pivotally connecting the first and second support plates 242, 246 to the support frame 150 by any suitable means, such as by a pin 252 as shown in FIG. 9. Thus, in an assembled position of the first and second support plates 242, 246 of the track engaging assembly 240 and the track 190, one of the wheels 244 journally connected to the first support plate 242 is positioned within the first channel 230 of the track 190 and rollingly engages the lower side 220 of the upper flange member 198, and two of the wheels 244 journally connected to the first support plate 242 are positionable on the upper side 218 of the upper flange member 198 of the track 190 for rolling engagement therewith. Similarly, one of the wheels 248 journally connected to the second support plate 246 is positioned within the second channel 232 of the track 190 and rollingly engages the lower side 220 of the upper flange member 198, and two of the wheels 248 journally connected to the second support plate 246 are positionable on the upper side 218 of the upper flange member 198 of the track 190 for rolling engagement therewith. Thus, the track 190 and the track engaging assembly 240 stabilize the opposed second end 60 of the carriage 20 as the carriage 20 is moved between the lowered position within the carriage receiving passageway 34 of the support frame 18 and one of the first and second, longitudinally shifted positions.

As previously stated the pipe loading assemblies 42, 46 of the materials lifting apparatus 10 are pivotally connected to the first and second sides 28 and 30, respectively, of the support frame 18 such that one of the pipe loading assemblies 42 is positionable in each of the vertically disposed slots 40 formed in the first side 28 of the support frame 18, and one of the pipe loading assemblies 46 is positionable in each of the vertically disposed slots 44 formed in the second side 30 of the support frame 18. The pipe loading assemblies 42 and 46 are each movable between a lower, inoperative position (as illustrated in FIG. 4) and a raised, operative position.

In the raised operative position the pipe loading assemblies 42, 46 position a section of the pipe 12 above the respective sides 28 and 30 of the support frame 18 so that the pipe 12 can, by gravity, be removed from the pipe loading assemblies 42 and 46 and positioned on the upper side 54 of the carriage 20 when the carriage 20 is in the lower, horizontally disposed position within the carriage receiving passageway 34 of the support frame 18 (see FIG. 3). It should be noted that at least two of the pipe loading assemblies 42 are pivotally connected to the first side 28 of the support frame 18 such that the pipe loading assemblies 42 are in a parallel, spatially disposed relationship substantially as shown in FIGS. 1-3. Similarly, at least two of the pipe loading assemblies 46 are pivotally connected to the second side 30 of the support frame 18 such that the pipe loading assemblies 46 are in a parallel, spatially disposed relationship substantially corresponding to the pipe loading assemblies 42 described above.

The pipe loading assemblies 42 are interconnected such that the movement of the pipe loading assemblies 42 between one of the lower position and the raised position is synchronized, thus stabilizing the pipe 12 supported on the pipe loading assemblies 42 during the movement of the pipe 12 from the pipe rack 14 to the carriage support surface 66 of the carriage 20. Likewise, the pipe loading assemblies 46 are interconnected such that the movement of the pipe loading assemblies 46 between one of the lower position and the raised position is synchronized, thus stabilizing the pipe 12 supported thereon during movement of the pipe 12 from the pipe rack 14 to the carriage support surface 66 of the carriage 20.

Referring more specifically to FIG. 4, one of each of the pipe loading assemblies 42, 46 of the materials lifting apparatus 10 of the present invention is illustrated. The pipe loading assemblies 42 and 46 are substantially identical, both in construction and operation. Thus, only pipe loading assembly 46 will be described in detail.

As illustrated in FIG. 4 the pipe loading assembly 46 comprises an arm 260, an end plate 262, and a ram 264. The arm 260, an elongated member, is provided with a first end 266, an opposed second end 268, an upper side 270, and a lower side 272. The opposed second end 268 of the arm 260 is pivotally connected to the second side 30 of the support frame 18 of the materials handling apparatus 10 via pin 274 such that the arm 260 is substantially centrally disposed in the vertically disposed slot 44 in the second side 30 of the support frame 18 substantially as shown. Thus, the arm 260 is movable between the lower, inoperative position (as illustrated in FIG. 4), and the raised, operative position.

The end plate 262, an arcuate shaped member, is provided with a first end 276, a second end 278, a first side 280, and a second side 282. The end plate 262 is connected to the first end 266 of the arm 260 such that the first end 276 of the end plate 262 extends a distance 284 from the upper side 270 of the arm 260 substantially as shown. Thus, the upper side 270 of the arm 260 and the first end 276 of the end plate 262 cooperate to form a pipe receiving cradle for supporting a section of the pipe (not shown) when moving a section of the pipe from the pipe rack 14 to the carriage 20 of the materials lifting apparatus 10 as illustrated in FIG. 1.

The ram 264 of the pipe loading apparatus 46, which is employed to move the arm 260 between the lowered inoperative position and the raised, operative position as heretofore described, is provided with a base portion 288 and a reciprocating rod 290. The base portion 288 is pivotally connected to the support frame 18 via a lug and a pin (not shown), the lug being positioned a distance below and aligned with the pivotal attachment of the opposed second end 268 of the arm 260 the second side 30 of the support frame 18. The reciprocating rod 290 of the ram 264 is pivotally connected via a pin 298 to the arm 260 of the pipe loading assembly 46 such that the pivotal attachment of the reciprocating rod 290 of the ram 264 is a distance from the pivotable attachment of the opposed second end 268 of the arm 260 to the second side 30 of the support frame 18. The pivotal connection of the ram 264 to the arm 260 of the pipe loading assembly 46, in combination with the pivotal attachment of same to the second side 30 of the support frame 18, enables the arm 260 to be moved between the lower, inoperative position and the raised operative position upon activation of the ram 264. Again, it should be noted that the plurality of the pipe loading assemblies 46 disposed on the second side 30 of the support frame 18 are connected, either in series or parallel, so that the movement of the pipe loading assemblies 46 are synchronized to stabilize the pipe (not shown) thereon as the pipe is moved from the pipe rack 14 to the carriage 20 of the materials handling apparatus 10.

The ram 264 of the pipe loading assembly 42 can be any suitable ram known in the art, such as a double-acting hydraulic ram. Because such rams are well known in the art, as well as their use, no further comments on the ram 264 is believed necessary.

Figure 7:
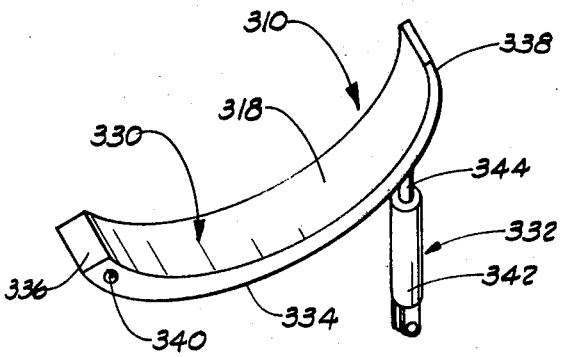
FIG. 7 is a perspective view of one of the pipe ejecting assemblies of the apparatus of the present invention.

Referring now to FIGS. 1, 6, and 7, the materials lifting apparatus 10 of the present invention further comprises a plurality of pipe ejecting assemblies 310 for removing the pipe 14 from the carriage 20 via the first side 28 of the support frame 18, and a plurality of pipe ejecting assemblies 312 for removing the pipe 14 from the carriage 20 via the second side 30 of the support frame 18. Two of the pipe ejecting assemblies 310 and two of the pipe ejecting assemblies 312 are illustrated in the materials handling apparatus 10 shown in FIG. 1.

In order to connect the pipe ejecting assemblies 310 and 312 to the carriage 20 of the materials lifting apparatus 10, the carriage 20 is provided with a plurality of elongated slots 314 and 316, each of the elongated slots 314 being adapted to receive one of the pipe ejecting assemblies 310, and each of the slots 316 being adapted to receive one of the pipe ejecting assemblies 312. The slots 314 and 316 of the carriage 20 are more clearly illustrated in FIG. 6. It should be noted that when the pipe ejecting assemblies 310 are positioned within the slots 314 of the carriage 20, and the pipe ejecting assemblies 312 are disposed in the slots 316 of the carriage 20, and the pipe ejecting assemblies 310, 312 are in a retracted, inoperative position, an upper side 318, 320 of each of the pipe ejecting assemblies 310, 312, respectively, is substantially coplaner with the upper side 54 of the carriage 20 forming the carriage support surface 66 of the materials lifting apparatus 10. Thus, the upper sides 318 and 320 of the pipe ejecting assemblies 310, 312, respectively, are provided with a concave cylindrical shaped surface substantially corresponding to the portion of the concave cylindrical shaped materials supporting surface 60 of the upper side 54 of the carriage 20.

Figure 10:
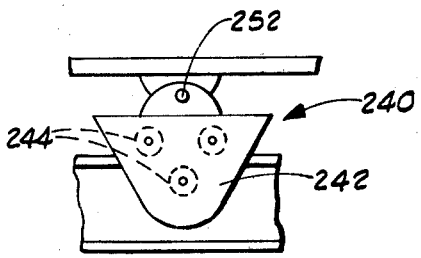
FIG. 10 is a partially broken perspective view of a second embodiment of the materials lifting apparatus of the present invention in which each end of the carriage is in a raised position.

The pipe ejecting assemblies 310, 312 are movable between the lower, inoperative position (as illustrated in FIG. 1), and a raised, operative position (one of the pipe ejecting assemblies 310 being shown in phantom in the raised, operative position in FIG. 4). In the raised, operative position the pipe ejecting assembly, such as pipe ejecting assembly 310, removes the pipe 12 from the carriage 20 of the materials lifting apparatus via the angularly disposed upper end 36 of the first side 28 of the support frame 18. It should be noted that at least two of the pipe ejecting assemblies 310 are operably disposed in the carriage 20 of the materials lifting apparatus 10 such that the two pipe ejecting assemblies 310 are in a parallel, spatially disposed relationship substantially as shown in FIGS. 1 and 10. Similarly, at least two of the pipe ejecting assemblies 312 are operably connected to the carriage 20 in a parallel, spatially disposed relationship as shown. It should further be noted that the pipe ejecting assemblies 310 are connected such that the movement of the pipe ejecting assemblies 310 between one of the lower position and the raised position is synchronized, thus stabilizing the pipe 12 supported thereon during the movement of the pipe 12 from the carriage 20 via the angularly disposed upper end 36 of the first side 28 of the support frame 18; and the pipe ejecting assemblies 312 are similarly connected, but independent of the pipe ejecting assemblies 310, for synchronized movement of the pipe ejecting assemblies 312 for removal of the pipe 12 from the carriage 20 of the materials lifting apparatus 10 via the angularly disposed upper end 38 of the second side 30 of the support frame 18.

The construction and connection of each of the pipe ejecting assemblies 310 and 312 to the carriage 20 of the materials handling apparatus 10 of the present invention are substantially identical. Thus, only one of the pipe ejecting assemblies 310 will be described in detail hereinafter.

Referring now to FIG. 7, the pipe ejecting assembly 310 comprises an arm 330 and a ram 332. The arm 330 of the pipe ejecting assembly 310, an elongated member, is provided with the before mentioned upper side 318, a lower side 334, a first end portion 336, and a second end portion 338. The first end portion 336 of the arm 330 is provided with a horizontally disposed bore 340 extending therethrough, the bore 340 being adapted to receive a pin (not shown) for pivotally connected the first end portion 336 of the arm 330 to the carriage 20 when the arm 330 is positioned within the slot 314 in the carriage 20.

The ram 332 pivotally connects the second end portion 338 of the arm 330 to the support frame 150 of the carriage 20. The ram 332 is provided with a base portion 342 and a reciprocating rod 344. The base portion 342 of the ram 332 is pivotally connected to the support frame 150 of the carriage 20 by any suitable means, such as a clevis, a lug, and a pin (not shown); and the reciprocating rod 344 of the ram 332 is pivotally connected to the lower side 334 of the arm 330 near the second end 338 thereof. The pivotal connection of the reciprocating rod 344 to the arm 330 of the pipe ejecting assembly 310 can be by any suitable means, well known in the art, such as a clevis, a lug, a pin, and the like (not shown).

The pivotal connection of the arm 330 of the pipe ejecting assembly 310 to the carriage 20 of the materials lifting apparatus 10, in combination with the pivotable attachment of the ram 332 to the arm 330 of the pipe ejecting assembly 310 and the support frame 150 of the carriage 20 enables the ram 332, upon activation, to pivotally move the arm 330 between the lower position and the raised, pipe ejecting position as heretofore described. The ram 332 employed in combination with the arm 330 of the pipe ejecting assembly 310 can be any suitable ram well known in the art, such as a double-acting hydraulic ram. Since such rams are well known in the art, as is their pivotal connection to various component parts of an apparatus, no further comment is believed necessary. However, it should be noted that the ram 332 is operably connected to its activating source such that the ram 332 can be activated only when the carriage 20 of the materials lifting apparatus 10 is in the substantially horizontally disposed position within the carriage receiving passageway 34 of the support frame 18. Thus, one cannot accidentally activate the ram 332 to eject the pipe 12 when the carriage 20 is in one of the raised positions.

As previously stated, the pipe ejecting assembly 312 is substantially identical in construction and operation to the before described pipe ejecting assembly 310. However, it should be noted that since the pipe ejecting assemblies 312 are employed to remove the pipe 12 from the carriage 20 via the angularly disposed upper end 38 of the second side 28 of the support frame 18, the pipe ejecting assemblies 312 are pivotally connected to the carriage 20 via their first end portions and the ram of the pipe ejecting assemblies 312 is pivotally positioned and connected to the second end portion of the arms of the pipe ejecting assemblies 312 and the support frame 150 of the carriage 20.

In the use of the materials lifting apparatus 10 of the present invention it may be, at times, desirable for the operator to be able to raise the opposed second end 60 of the carriage 20, especially when the materials lifting apparatus 10 is employed on a drilling derrick wherein the derrick floor is disposed a substantial distance above ground level. Such versatility to the materials lifting apparatus 10 of the present invention can readily be achieved by making certain modifications to the materials lifting apparatus 10. Except for the modifications to the materials lifting apparatus 10 as hereinafter set forth, the components and functions of such components are substantially identical as heretofore set forth.

Referring now to FIG. 10 a modified materials handling apparatus **10*a* comprises the support frame 18 having the carriage receiving passageway 34 formed therein, the carriage 20, the forward linkage assembly 22, the support members 62, 64, the adjustable stop assembly 61, the pipe ejecting assemblies 310, 312, the pipe loading assemblies 42, 46, and the track 190 as heretofore described with reference to the drawings illustrating the materials loading apparatus 10. However, since it is desirable in certain situations to be able to raise the opposed second end 60 of the carriage 20 when the first end 58 of the carriage 20 is in one of the raised, longitudinally shifted positions as heretofore described, the materials handling apparatus 10*a* further comprises a track engaging assembly 240*a*, a stop member 440, and a rear linkage assembly 442. The track engaging assembly 240*a* of the modified materials lifting apparatus 10*a* is substantially identical in construction to the track engaging assembly 240 except that the track engaging assembly 240 is positioned a distance from the second end 160 of the support frame 150 and is pivotally connected to the second end 160 of the support frame 150 via the rear linkage assembly 442. The track engaging assembly 440 rollingly engages the track 190 and supports the carriage 20 as the first end 58 of the carriage 20** is moved between the lowered position and one of the raised, longitudinally shifted positions.

Figure 11:
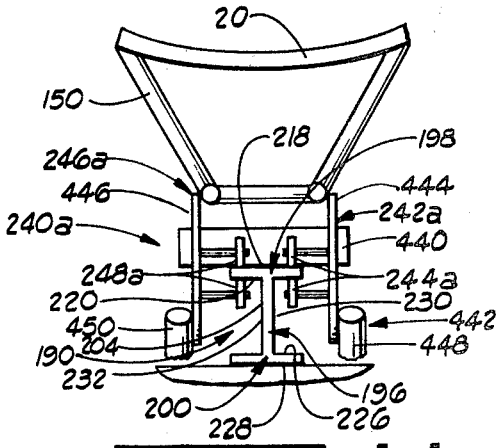
FIG. 11 is an enlarged, partially broken end view illustrating the track engaging assembly of the materials lifting apparatus of FIG. 10.
Figure 10:
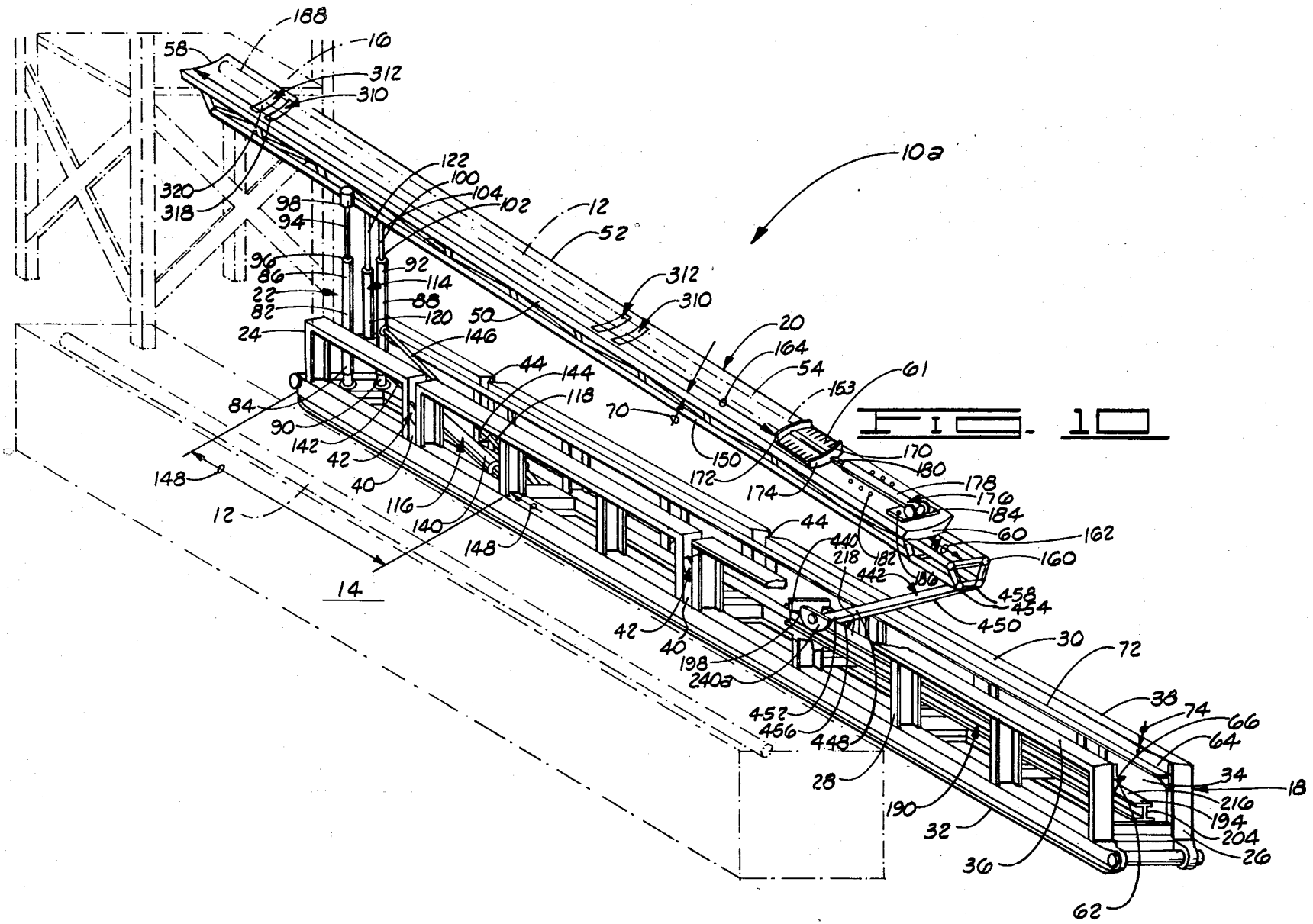

Referring more specifically to FIG. 11 the track engaging assembly **240*a* comprises a vertically disposed first support plate 242*a* having a plurality of wheels 244*a* journally connected thereto, and a parallel, spatially disposed second support plate 246*a* having a plurality of wheels 248*a* journally connected thereto. The first and second support plates 242*a*, 246*a* are further provided with upper ends 444, 446, respectively, each of which abuts and supports the support frame 150 of the carriage 20 when the carriage 20 is in the lowered position or the first end 58 of the carriage is in one of the first or second raised, longitudinally shifted positions and the opposed second end 60 of the carriage 20 has not been moved to the raised position via the engagement of the first and second support plates 242*a*, 246*a* with the stop member 440 and the rear linkage assembly 442** as will be described in more detail hereinafter.

Referring again to FIG. 10 the stop member 440, depicted as a plate, is secured to the upper side 218 of the upper flange member 198 of the track 190 in close proximity to the first end 214 of the upper flange member 198. The stop member 440 is of a length sufficient to engage the first and second support plates **242*a*, 246*a* when the track engaging assembly 240*a* is moved along the track 190 to the position of engagement with the stop member 440. The stop member 440 is positioned on the upper flange member 198 of the track 190 at a predetermined position such that upon the support plates 242*a*, 246*a* of the track engaging assembly 240*a* contacting the stop member 440 the opposed second end 60 of the carriage 20 starts to move in an upward direction as illustrated. Such is accomplished because the support frame 150 of the carriage 20 is connected to the first and second support plates 242*a*, 246*a* of the track engaging assembly 240*a* via the rear linkage assembly 442**.

The rear linkage assembly 442 comprises a first linkage member 448 and a parallel, spatially disposed second linkage member 450. The first linkage member 448 is provided with a first end portion 452 and an opposed second end portion 454; and the second linkage member 450 is provided with a first end portion 456 and an opposed second end portion 458. The first end portion 452 of the first linkage member 448 is pivotally connected to the first support plate 242a of the track engaging assembly 240a by any suitable means, such as a pin (not shown); and the opposed second end portion 454 of the first linkage member 448 is pivotally connected to the second end 160 of the support frame 150 of the materials handling apparatus 10a by any suitable means, such as a pin (also not shown).

The first end portion 456 of the second linkage member 450 is pivotally connected to the second support plate 246a of the track engaging assembly 240a by any suitable means, such as a pin (not shown); and the opposed second end portion 458 of the second linkage member 450 is pivotally connected to the second end 160 of the support frame 150 of the materials handling apparatus 10a by any suitable means, such as a pin (not shown). Thus, in an assembled position the first and second linkage members 448, 450 stabilize and support the opposed second end 60 of the carriage 20 as same is moved between the lowered position and the raised position. It should be noted that the first and second linkage members 448, 450 of the rear linkage assembly 442 have been illustrated and described as elongated unitary members. However, it should be understood that one may construct the first and second linkage members 448, 450 of the rear linkage assembly 442 as telescoping members and provide a hydraulic ram therebetween similar in construction and operation to the first and second tubular linkage members 82, 88, the first and second linkage members 94, 100, and the ram 114 of the forward linkage assembly 22 as heretofore described. In the event one constructs the rear linkage assembly 442 with the before mentioned telescoping members and hydraulic ram it is readily apparent that the height of the opposed second end 60 of the carriage 20 can be varied when same is in the raised position.

When the before-described rams of the forward linkage assembly 22, the pipe loading assemblies 42, 46 the adjustable stop assembly 61, and the pipe ejecting assemblies 310, 312 of the materials lifting apparatus 10 and 10a of the present invention are double-acting hydraulic rams, the materials lifting apparatus 10 and 10a can be provided with the necessary auxillary equipment for operation of such rams. For example and as schematically illustrated in FIG. 2, the auxillary equipment can include a diesel motor 500, a diesel fuel tank 502, and a hydraulic fluid reservoir 504, each of which are operably interconnected and connected to the before mentioned rams for providing the desired hydraulic fluid to the base portion of each of the rams for selective movement of the reciprocating rods of same. Further, the rams of the various components of the materials lifting apparatus 10 and 10a of the present invention can be interconnected using any suitable means known in the art, provided that the components can be selectively, and independently activated as heretofore described. Further, the controls for operating the hydraulic rams can be arranged so that such operations can be controlled from the derrick floor, or from a position adjacent the materials handling apparatus 10 and 10a.

In order to more fully describe the materials handling apparatus 10 of the present invention, a brief description of its operation will now be set forth.

Operation

The materials lifting apparatus 10 of the present invention can be transported to the drilling site by any suitable means, such as a heavy duty low-bed trailer or truck (not shown). Once the materials lifting apparatus has been transported to the site the apparatus can be unloaded and slidably positioned in place adjacent the pipe rack 14 by any suitable means, since the frame 18 can function as a sled for the materials lifting apparatus 10. Once the materials lifting apparatus 10 has been moved to the desired position, the operator positions the adjustable stop assembly 61 on the carriage 20 at the desired location. Thereafter, the desired pipe loading assembly, such as the pipe loading assembly 46, is activated and engages a section of the pipe 12 positioned on the pipe rack 14 for removal of the pipe 12 therefrom and to position the pipe 12 on the carriage 20 of the materials lifting apparatus 10. Once the pipe has been positioned on the carriage 20, the forward linkage assembly 22 is activated so that the first end 58 of the carriage 20 is moved to the desired raised, longitudinally shifted position wherein the first end 58 of the carriage is disposed above the derrick floor 16.

In order to assist in the removal of the pipe 12 from the carriage 20, when the first end 58 of the carriage 20 is disposed above the derrick floor 16, the adjustable stop assembly 61 is activated so that the pipe 12 is slidably moved along the length of the carriage 20 to a position wherein one end of the pipe 12 extends over the derrick floor 16 a distance from the first end 58 of the carriage 20. The pipe handling equipment of the drilling rig (not shown) can then be attached to the outwardly extending end portion of the pipe 12 so that the pipe 12 can be removed from the carriage.

It should be noted that when the forward linkage assembly 22 is activated to move the carriage 20 from the horizontally disposed lowered position within the carriage receiving passageway 34 of the carriage 20, the pipe loading assemblies of the materials lifting apparatus 10, such as the pipe loading assemblies 42, are inoperative so that the pipe loading assemblies 42 remains in their lower inoperative positions. This safety feature can be built in by a suitable hydraulic arrangement which is well known in the art, and thus will prevent the operator from inadvertently engaging a section of pipe 12 on the pipe rack 14 when the carriage 20 of the materials lifting apparatus 10 is in one of the raised positions.

When the materials lifting apparatus 10 is employed to remove pipe from the derrick floor 16, the pipe is positioned upon the carriage 20 (while the first end 58 of the carriage is in the raised, longitudinally shifted position and disposed above the derrick floor 16) and the adjustable stop assembly 61 is selectively activated so as to retract the reciprocating rod of the assembly and enable the pipe 12 to be slidably moved along the carriage 20 to a position where the pipe 12 completely rests on the carriage 20. Thereafter, the forward linkage assembly is selectively activated to lower the first end 58 of the carriage 20 so that the carriage 20 is horizontally disposed in the carriage receiving passageway 34 of the support frame 18.

In order to remove the pipe 12 from the carriage 20 (when the carriage 20 is in the horizontally disposed position within the carriage receiving passageway 34 of the support frame 18) the desired pipe ejecting assemblies, such as the pipe ejecting assemblies 310, are activated so that the pipe 12 is removed from the carriage 20 and thus the materials lifting apparatus 10 via the angularly disposed upper end 36 of the first side 28 of the support frame 18.

The operation of the materials lifting apparatus 10a is substantially identical to that of the apparatus 10, with the exception of the movement of the opposed second end 60 of the carriage 20 via the rear linkage assembly 442 as heretofore described. Thus, no further discussion on the operation of the materials lifting apparatus 10*a* is believed necessary.

The materials lifting apparatus 10 and 10*a* of the present invention can be fabricated of any suitable material, and can be of varying sizes depending upon the particular application in which the materials lifting apparatus is used. Further, it is clear that the present invention is well adapted to carry out the objects and obtain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the following claims.

What is claimed is:

1. A materials lifting apparatus comprising:

a support frame having a first end and an opposed second end, the support frame defining a carriage receiving passageway extending between the first and opposed second ends thereof;

a carriage positionable within the carriage receiving passageway and adapted to receive and support materials thereon, the carriage having a first end and an opposed second end;

means for connecting the opposed second end of the carriage to the support frame so as to secure the opposed second end of the carriage to the support frame while providing relative movement between the opposed second end of the carriage and the support frame; and forward linkage means for pivotally connecting the first end of the carriage to the support frame, the forward linkage means movable between a lowered position and a raised position, in the lowered position the forward linkage means disposed within the carriage receiving passageway between the first and second ends of the carriage and maintaining the carriage in a substantially horizontal position within the carriage receiving passageway of the support frame, in the raised position the forward linkage means maintaining the first end of the carriage in a raised, longitudinally shifted position a distance from the first end of the support frame; the forward linkage assembly comprising:

at least one tubular linkage member having a first end portion and an opposed second end portion, the first end portion of the tubular linkage member pivotally connected to the first end of the support frame;

at least one linkage member having a first end portion and an opposed second end portion, the linkage member extends a distance from the opposed second end portion of the tubular linkage member, the opposed second end portion of the linkage member pivotally connected to the carriage; and at least one second ram having a base portion and a reciprocating rod, the base portion of the ram pivotally connected to the support frame, the reciprocating rod pivotally connected to at least one of the tubular linkage member such that upon activation of the second ram the carriage is movable between the substantially horizontal position in the carriage receiving passageway of the support frame and the raised, longitudinally shifted position.

2. The materials lifting apparatus of claim 1 wherein the support frame comprises:

a first side having an upper end, a lower end, a first end, and an opposed second end;

a parallel, spatially disposed second side having an upper end, a lower end, a first end, and an opposed second end; and a plurality of cross support member disposed between and connected to the first and second sides such that in an assembled position the first side, the second side, and the cross support members cooperate to form the carriage receiving passageway of the support frame.

3. The materials lifting appearing of claim 2 wherein the carriage is provided with an upper side, a lower side, a first side, a second side, a first end, and an opposed second end, the upper side of the carriage forming a concave, cylindrically shaped materials supporting surface, the carriage being positioned in the carriage receiving passageway of the support frame such that the first side of the carriage is substantially adjacent the upper end of the first side of the support frame and the second side of the carriage is substantially adjacent the upper end of the second side of the support frame when the carriage is in the horizontal position in the carriage receiving passageway of the support frame.

4. The materials lifting apparatus of claim 3 which further comprises:

adjustable stop means for supporting material on the upper side of the carriage as the carriage is moved between the horizontal position and the raised, longitudinally shifted position, the adjustable stop means positioned on the upper side of the carriage and operably connected to the carriage such that the adjustable stop means is movable between a retracted position and an extended position, in the retracted position the adjustable stop means being disposed a selected distance from the opposed second end of the carriage, in the extended position the adjustable stop means being moved in the direction of the first end of the carriage.

5. The materials lifting apparatus of claim 4 further comprising:

material loading means pivotally connected to at least one of the first and second sides of the support frame, the material loading means being movable between a lowered position and a raised position, the material loading means adapted to engage material positioned adjacent one of the first and second sides of the support frame and move the material to the carriage of the materials lifting apparatus as the material loading means moves from the lowered position to the raised position.

6. The materials lifting apparatus of claim 5 wherein the material loading means comprises:

a plurality of parallel, spatially disposed first arms, each of the first arms having a first end, an opposed second end, and an upper side;

first pivot means for pivotally connecting the first end of each of the first arms to the first side of the support frame such that the first arms can be disposed in a lower first position substantially adjacent the first side of the support frame; and first arm actuating means operably connecting the second end of each of the first arms to the support frame such that upon activation of the first arm actuating means the first arms are syncronized in movement between the lower first position and a raised second position wherein the opposed second ends of the first arms are positioned substantially adjacently the upper side of the carriage and the first end of the first arms is positioned substantially above the upper side of the carriage such that materials supported by the upper side of the first arms can be deposited on the upper side of the carriage.

7. The materials lifting apparatus of claim 6 wherein the material loading means further comprises:

a plurality of parallel, spatially disposed second arms, each of the second arms having a first end, an opposed second end, and an upper side;

second pivot means for pivotally connecting the first end of each of the second arms to the second side of the support frame such that the second arms can be disposed in a lower first position substantially adjacent the second side of the support frame; and second arm actuating means operably connecting the second end of each of the second arms to the support frame such that upon activation of the second arm actuating means the second arms are syncronized in movement between the lower first position and a raised second position wherein the opposed second ends of the second arms are positioned substantially adjacently the upper side of the carriage and the first ends of the second arms is positioned substantially above the upper side of the carriage such that materials supported by the upper side of the second arms can be deposited on the upper side of the carriage.

8. The materials lifting apparatus of claim 3 wherein the carriage is provided with at least two substantially parallel, spatially disposed first slots extending therethrough, the first slots being transversely disposed in the carriage such that the elongated axis of the first slots are substantially normal to the elongated axis of the carriage, and wherein the apparatus further comprises:

material ejecting means operably connected to the carriage for removing materials therefrom, the materials ejecting means movable between a retracted position and a raised position, in the retracted position the material ejecting means being positioned in the slots of the carriage, in the raised position the material ejecting means removing material from the carriage via one of the first and second sides of the support frame.

9. The materials lifting apparatus of claim 8 wherein the material ejecting means comprises:

a plurality of first arms, one of each of the first arms positionable in one of the transversely disposed first slots, each of the first arms having a first end portion, a second end portion, an upper side, and a lower side, the first end portion of the first arms pivotally connected to the carriage; and first arms actuating means operably connected to the second end portion of the first arms for selectively moving the first arms between the retracted position and the raised position.

10. The materials lifting apparatus of claim 9 wherein the carriage is provided with at least two substantially parallel, spatially disposed second slots extending therethrough, the second slots being transversely disposed in the carriage such that the elongated axis of the second slots are substantially normal to the elongated axis of the carriage, and wherein the material ejecting means further comprises:

a plurality of second arms, one of each of the second arms positionable in one of the transversely disposed second slots, each of the second arms having a first end portion, a second end portion, an upper side, and a lower side, the first end portion of the second arms pivotally connected to the carriage; and second arms actuating means operably connected to the second end portion of the second arms for selectively moving the second arms between the retracted position and the raised position.

11. The materials lifting apparatus of claim 10 wherein the upper end of the first side of the support frame is angularly disposed in an outward, downwardly extending direction away from the first side of the support frame and the carriage receiving passageway of the support frame.

12. The materials lifting apparatus of claim 11 wherein the upper end of the second side of the support frame is angularly disposed in an outward, downwardly extending direction away from the second side of the support frame and the carriage receiving passageway of the support frame.

13. The materials lifting apparatus of claim 1 wherein the forward linkage means includes a pair of the tubular linkage members and a pair of the linkage members, and wherein the forward linkage member further comprises:

a first ram having a base portion and a reciprocating rod, the base portion of the first ram positioned between the tubular linkage member and pivotally connected thereto the reciprocating rod of the ram pivotally connected to the carriage such that when the carriage is in the raised, longitudinally shifted position activation of the ram causes the carriage to be moved between the raised longitudinally shifted position and a second raised longitudinally shifted position.

14. The materials lifting apparatus of claim 2 which further comprises:

a first carriage support member connected to the first side of the support frame such that the first carriage support member extends a distance into the carriage receiving passageway of the support frame in the direction of the second side; and a parallel, spatially disposed second carriage support member connected to the second side of the support frame such that the second carriage support extends a distance into the carriage receiving passageway of the support frame in the direction of the first side, the first and second carriage support members cooperating to receiving and support the carriage in the carriage receiving passageway when the carriage is in the substantially horizontal position, the first and second carriage support members supporting the opposed second end of the carriage as the carriage is moved between the horizontal position and the raised, longitudinally shifted position.

15. An apparatus for moving pipe between a pipe rack and a derrick floor comprising:

a support frame having a first end, an opposed second end, a first side, an opposed second side, and a lower side, the first and second sides being connected by the lower side of the support frame to provide a carriage receiving passageway therein;

an elongated carriage having a first side, an opposed second side, an upper side, a lower side, a first end, and an opposed second end, the carriage being positionable within the carriage receiving passageway of the support frame;

a carriage support positioned within the carriage receiving passageway and connected to the support frame such that the carriage support receives and supports the carriage in the carriage receiving passageway of the support frame; and forward linkage means for pivotably connecting the first end of the carriage to the support frame, the forward linkage means movable between a lowered position and a raised position, in the lowered position of the forward linkage means the carriage being supported in a substantially horizontal position within the carriage receiving passageway of the support frame by the carriage support, in the raised position of the forward linkage means the first end of the carriage being supported in a raised, longitudinally shifted position a distance from the first end of the support frame, the opposed second end of the carriage being supported by the carriage support, the forward linkage means comprising:

at least one tubular linkage member having a first end portion and an opposed second end portion, the first end portion of the tubular linkage member pivotally connected to the first end of the support frame;

at least one linkage member having a first end portion and an opposed second end portion, the linkage member extends a distance from the opposed second end portion of the tubular linkage member, the opposed second end portion of the linkage member pivotally connected to the carriage;

a first ram having a base portion and a reciprocating rod, the base portion of the first ram positioned near the tubular linkage member and pivotally connected thereto, the reciprocating rod of the ram pivotally connected to the carriage such that when the carriage is in the raised, longitudinally shifted position activation of the ram causes the carriage to be moved between a raised, longitudinally shifted position and a second raised longitudinally shifted position; and at least one second ram having a base portion and a reciprocating rod, the base portion of the ram pivotally connected to the support frame, the reciprocating rod pivotally connected to at least one of the tubular linkage member such that upon activation of the second ram the carriage is movable between the substantially horizontal position in the carriage receiving passageway of the support frame and the raised, longitudinally shifted position.

16. The apparatus of claim 15 further comprising:

adjustable stop means for supporting material on the upper side of the carriage as the carriage is moved between the horizontal position and the raised, longitudinally shifted position, the adjustable stop means positioned on the upper side of the carriage and adjustably connected to the carriage, the adjustable stop means movable between a retracted position and an extended position, in the retracted position the adjustable stop means being disposed a selected first distance from the opposed second end of the carriage, in the extended position the adjustable stop means being moved in the direction of the first end of the carriage.

17. The apparatus of claim 16 wherein the adjustable stop means comprises:

a base plate slidably positionable on the upper side of the carriage;

at least one substantially vertically disposed upright member connected to the base plate and adapted to abutt a pipe positioned on the carriage to stabilize the pipe as the carriage is moved between the substantially horizontal position and the raised, longitudinally shifted position; and a ram having a base portion and a reciprocating rod, the reciprocating rod being connected to the base plate, the base portion of the ram connected to the upper side of the carriage such that reciprocating movement of the reciprocating rod is along the longitudinal axis of the carriage.

18. The apparatus of claim 16 further comprising:

pipe loading means pivotally connected to at least one of the first and second sides of the support frame, the pipe loading means being movable between a lowered position and a raised position, the pipe loading means adapted to engage a section of pipe positioned adjacent one of the first and second sides of the support frame and move the pipe to the carriage of the apparatus as the pipe loading means moves from the lowered position to the raised position.

19. The apparatus of claim 18 wherein the pipe loading means comprises:

a plurality of parallel, spatially disposed first arms, each of the first arms having a first end, an opposed second end, and an upper side;

first pivot means for pivotally connecting the first end of each of the first arms to the first side of the support frame such that the first arms can be disposed in a lower first position substantially adjacent the first side of the support frame; and first arm actuating means operably connecting the second end of each of the first arms to the support frame such that upon activation of the first arm actuating means the first arms are syncronized in movement between the lower first position and a raised second position wherein the opposed second ends of the first arms are positioned substantially adjacently the upper side of the carriage and the first end of the first arms is positioned substantially above the upper side of the carriage such that pipe supported by the upper side of the first arms can be deposited on the upper side of the carriage.

20. The apparatus of claim 19 wherein the pipe loading means further comprises:

a plurality of parallel, spatially disposed second arms, each of the second arms having a first end, an opposed second end, and an upper side;

second pivot means for pivotally connecting the first end of each of the second arms to the second side of the support frame such that the second arms can be disposed in a lower first position substantially adjacent the second side of the support frame; and second arm actuating means operably connecting the second end of each of the second arms to the support frame such that upon activation of the second arm actuating means the second arms are syncronized in movement between the lower first position and a raised second position wherein the opposed second ends of the second arms are positioned substantially adjacently the upper side of the carriage and the first ends of the second arms is positioned substantially above the upper side of the carriage such that materials supported by the upper side of the second arms can be deposited on the upper side of the carriage.

21. The apparatus of claim 15 wherein the carriage is provided with at least two substantially parallel, spatially disposed first slots extending therethrough, the first slots being transversely disposed in the carriage such that the elongated axis of the first slots are substantially normal to the elongated axis of the carriage, and wherein the apparatus further comprises:

pipe ejecting means operably connected to the carriage for removing pipe therefrom, the pipe ejecting means movable between a retracted position and a raised position, in the retracted position the pipe ejecting means being positioned in the slots of the carriage, in the raised position the pipe ejecting means removing pipe from the carriage via one of the first and second sides of the support frame.

22. The apparatus of claim 21 wherein the pipe ejecting means comprises:

a plurality of first arms, one of each of the first arms positionable in one of the transversely disposed first slots, each of the first arms having a first end portion, a second end portion, an upper side and a lower side, the first end portion of the arms pivotally connected to the carriage; and first arms actuating means operably connected to the second end portion of the first arms for selectively moving the first arms between the retracted position and the raised position.

23. The apparatus of claim 21 wherein the carriage is provided with at least two substantially parallel, spatially disposed second slots extending therethrough, the second slots being transversely disposed in the carriage such that the elongated axis of the second slots are substantially normal to the elongated axis of the carriage, and wherein the pipe ejecting means further comprises:

a plurality of second arms, one of each of the second arms positionable in one of the transversely disposed second slots, each of the second arms having a first end portion, a second end portion, an upper side, and a lower side, the first end portion of the second arms pivotally connected to the carriage; and second arms actuating means operably connected to the second end portion of the second arms for selectively moving the second arms between the retracted position and the raised position.

24. The apparatus of claim 23 wherein the upper end of the first side of the support frame is angularly disposed in an outward, downwardly extending direction away from the first side of the support frame and the carriage receiving passageway of the support frame.

25. The apparatus of claim 24 wherein the upper end of the second side of the support frame is angularly disposed in an outward, downwardly extending direction away from the second side of the support frame and the carriage receiving passageway of the support frame.

26. The apparatus of claim 15 wherein the carriage support comprises:

a first carriage support member connected to the first side of the support frame such that the first carriage support member extends a distance into the carriage receiving passageway of the support frame in the direction of the second side; and a parallel, spatially disposed second carriage support member connected to the second side of the support frame such that the second carriage support extends a distance into the carriage receiving passageway of the support frame in the direction of the first side, the first and second carriage support members cooperating to receiving and support the carriage in the carriage receiving passageway when the carriage is in the substantially horizontal position, the first and second carriage support members supporting the opposed second end of the carriage as the carriage is moved between the horizontal position and the raised, longitudinally shifted position.

27. A materials lifting apparatus comprising:

a support frame having a first end and an opposed second end, the support frame defining a carriage receiving passageway extending between the first and opposed second ends thereof;

a carriage positionable within the carriage receiving passageway and adapted to receive and support materials thereon, the carriage having a first end and an opposed second end;

a track assembly connected to the support frame, the track assembly being positioned between the support frame and the carriage such that the track assembly extends from the opposed second end of the support frame in the direction of the first end of the support frame, the track assembly comprising:

a substantially vertically disposed elongated member having a first end, an opposed second end, a first side, an opposed second side, an upper side and an opposed lower side;

an upper flange member having a first end, an opposed second end, an upper side and an opposed lower side; and a substantially parallel lower flange member having a first end, an opposed second end, an upper side and an opposed lower side, the upper flange member being connected to the upper side of the elongated member via the opposed lower side of the upper flange member and the lower flange being connected to the opposed lower side of the elongated member via the upper side of the lower flange member such that the upper flange member, the first side of the elongated member, and the lower flange member cooperate to form a first channel therebetween, and the upper flange member, the second side of the elongated member and the lower flange member cooperate to form a second channel therebetween;

track engaging means pivotally connected to the opposed second end of the carriage for slidably connecting the opposed second end of the carriage to the track assembly, the track engaging means comprising:

a first support plate having an upper end;

at least one first wheel journally connected to the first support plate such that the first wheel is positionable within the first channel of the track for rolling engagement with the lower side of the upper flange member;

at least one second wheel journally connected to the first support plate such that the second wheel is positionable on the upper flange member of the track for rolling engagement with the upper side of the upper flange member;

a second support plate having an upper end;

the second support plate being positioned in a parallel, spatial relationship with the first support plate;

at least one first wheel journally connected to the second support plate such that the first wheel is positionable within the second channel of the track for rolling engagement with the lower side of the upper flange member; and at least one second wheel journally connected to the second support plate such that the second wheel is positionable on the upper flange member of the track for rolling engagement with the upper side of the upper flange member;

forward linkage means for pivotally connecting the first end of the carriage to the support frame, the forward linkage means movable between a lowered position and a raised position, in the lowered position the forward linkage means maintaining the carriage in a substantially horizontal position within the carriage receiving passageway of the support frame, in the raised position the forward linkage means maintaining the first end of the carriage in a raised, longitudinally shifted position a distance from the first end of the support frame;

a carriage support frame connected to the lower side of the carriage, the carriage support frame having a first end and a second end, the first end of the carriage support being positioned adjacent the carriage such that the first end of the carriage support is below the carriage a distance from the first end of the carriage, the second end of the carriage support extending a distance outwardly from the opposed second end of the carriage;

a stop member connected to the first end of the track for engaging the first and second support plates of the track engaging means and stopping the movement of same along the track; and means for pivotally connecting the first and second support plates of the track engaging means to the second end of the carriage support frame, said means comprising:

a first linkage member having a first end portion and an opposed second end portion, the first end portion of the first linkage member pivotally connected to the first support plate and the opposed second end portion of the first linkage member pivotally connected to the second end of the carriage support frame; and a second linkage member having a first end portion and an opposed second end portion, the first end portion of the second linkage member pivotally connected to the second support plate and the opposed second end portion of the second linkage member pivotally connected to the second end of the carriage support frame, the first and second linkage member cooperating with the stop member so that upon the first and second support plate of the track engaging means contacting the stop member the opposed second end of the carriage is movable to a raised position where the opposed second end of the carriage is supported by the first and second linkage members.

28. The materials lifting apparatus of claim 27 wherein the means for pivotally connecting the first and second support plates of the track engaging means to the second end of the carriage support frame comprises a pin positionable through the upper end of each of the first and second support plates for pivotally connecting same to the second end of the carriage support frame.

29. An apparatus for moving pipe between a pipe rack and a derrick floor comprising:

a support frame having a first end, an opposed second end, a first side, an opposed second side, and a lower side, the first and second sides being connected by the lower side of the support frame to provide a carriage receiving passageway therein;

an elongated carriage having a first side, an opposed second side, an upper side, a lower side, a first end and an opposed second end, the carriage being positionable within the carriage receiving passageway of the support frame;

a carriage support positioned within the carriage receiving passageway and connected to the support frame such that the carriage support receives and supports the carriage in the carriage receiving passageway of the support frame;

forward linkage means for pivotably connecting the first end of the carriage to the support frame, the forward linkage means movable between a lowered position and a raised position, in the lowered position of the forward linkage means the carriage being supported in a substantially horizontal position within the carriage receiving passageway of the support frame by the carriage support, in the raised position of the forward linkage means the first end of the carriage being supported in a raised, longitudinally shifted position a distance from the first end of the support frame, the opposed second end of the carriage being supported by the carriage support;

a track connected to the support frame, the track being positioned between the support frame and the carriage such that the track extends from the opposed second end of the support frame in the direction of the first end of the support frame, the track comprising:

a substantially vertically disposed elongated member having a first end, an opposed second end, a first side, an opposed second side, an upper side and an opposed lower side;

an upper flange member having a first end, an opposed second end, an upper side and an opposed lower side; and a substantially parallel lower flange member having a first end, an opposed second end, an upper side and an opposed lower side, the upper flange member being connected to the upper side of the elongated member via the opposed lower side of the upper flange member and the lower flange being connected to the opposed lower side of the elongated member via the upper side of the lower flange member such that the upper flange member, the first side of the elongated member and the lower flange member cooperate to form a first channel therebetween, and the upper flange member, the second side of the elongated member and the lower flange member cooperate to form a second channel therebetween;

track engaging means pivotally connected to the opposed second end of the carriage for slidably connecting the opposed second end portion of the carriage to the track, the track engaging means comprising:

a first support plate having an upper end;

at least one first wheel journally connected to the first support plate such that the first wheel is positionable within the first channel of the track for rolling engagement with the lower side of the upper flange member;

at least one second wheel journally connected to the first support plate such that the second wheel is positionable on the upper flange member of the track for rolling engagement with the upper side of the upper flange member;

a second support plate having an upper end;

the second support plate being positioned in a parallel, spatial relationship with the first support plate;

at least one first wheel journally connected to the second support plate such that the first wheel is positionable within the second channel of the track for rolling engagement with the lower side of the upper flange member; and at least one second wheel journally connected to the second support plate such that the second wheel is positionable on the upper flange member of the track for rolling engagement with the upper side of the upper flange member;

a carriage support frame connected to the lower side of the carriage, the carriage support frame having a first end and a second end, the first end of the carriage support being positioned adjacent the carriage such that the first end of the carriage support is below the carriage a distance from the first end of the carriage, the second end of the carriage support extending a distance outwardly from the opposed second end of the carriage;

a stop member connected to the first end of the track for engaging the first and second support plates of the track engaging means and stopping the movement of same along the track; and connecting means for pivotally connecting the first and second support plates of the track engaging means to the second end of the carriage support frame, comprising:

a first linkage member having a first end portion and an opposed second end portion, the first end portion of the first linkage member pivotally connected to the first support plate and the opposed second end portion of the first linkage member pivotally connected to the second end of the carriage support frame; the first end portion of the second linkage member pivotally connected to the second support plate and the opposed second end portion of the second linkage member pivotally connected to the second end of the carriage support frame, the first and second linkage member cooperating with the stop member so that upon the first and second support plate of the track engaging means contacting the stop member the opposed second end of the carriage is movable to a raised position where the opposed second end of the carriage is supported by the first and second linkage members.

30. The apparatus of claim 29 wherein the connecting means for pivotally connecting the first and second support plates of the track engaging means to the second end of the carriage support frame comprises a pin positionable through the upper end of each of the first and second support plates for pivotally connecting same to the second end of the carriage support frame.

* * * * *